United States Patent [19]

Hata et al.

[11] Patent Number: 4,786,898

[45] Date of Patent: Nov. 22, 1988

[54] ELECTROSTATIC DISPLAY APPARATUS

[75] Inventors: Kazuo Hata; Hidehiko Togo, both of Kakogawa, Japan

[73] Assignee: Daiwa Shinku Corporation, Hyogo, Japan

[21] Appl. No.: 104,537

[22] Filed: Sep. 30, 1987

Related U.S. Application Data

[63] Continuation of Ser. No. 701,859, Feb. 14, 1985, abandoned.

[30] Foreign Application Priority Data

Feb. 15, 1984 [JP] Japan ..... 59-27723
Feb. 15, 1984 [JP] Japan ..... 59-27724

[51] Int. Cl.[4] ..... G09G 3/34
[52] U.S. Cl. ..... 340/783; 340/792; 340/815.05
[58] Field of Search ..... 340/763, 783, 784, 792, 340/815.09, 815.08, 815.05

[56] References Cited

U.S. PATENT DOCUMENTS

| | | | |
|---|---|---|---|
| 3,432,846 | 3/1969 | Jones et al. | 340/792 |
| 3,623,070 | 11/1971 | Johnson et al. | 340/792 |
| 3,648,281 | 3/1972 | Dahms et al. | 340/783 |
| 4,205,312 | 5/1980 | Nelson | 340/792 |
| 4,468,663 | 8/1984 | Kalt | 340/783 |
| 4,652,868 | 3/1987 | Hart | 340/815.05 |

*Primary Examiner*—Gerald L. Brigance
*Attorney, Agent, or Firm*—Koda and Androlia

[57] ABSTRACT

The present electrostatic display apparatus has its display panel constituted by many electrostatically operated display units arranged along the length and breadth forming a matrix. Each of the display units basically consists of a fixed and a movable electrodes, between which a high-tension voltage is supplied to bend the movable electrode by electrostatic force so as to cover the fixed electrode. With the fixed electrode covered or uncovered, each of the display units has its appearance changed, and serves as one of the dots constituting a pattern to be displayed and the present apparatus can display a static, a moving and a flowing pattern both in a positive image mode and in a negative image mode.

4 Claims, 6 Drawing Sheets

ELECTROSTATIC DISPLAY APPARATUS

This is a continuation of application Ser. No. 701,859 filed Feb. 14, 1985 abandoned.

BACKGROUND OF THE INVENTION

1. Field of the Invention

The present invention relates to an electrostatic display apparatus, and more particularly to an apparatus for displaying a pattern on a matrix type display board constituted of many electrostatically operated display units.

2. Prior Art

Firstly the principle of operation of an electrostatic display apparatus is described. The apparatus comprises a display board which is constituted of many electrostatic display units arranged along the length and breadth so as to form a display matrix. Each of the electrostatic display units is made up of a pair of electrodes: one is fixed and the other is movable. The fixed electrode is coated with a dielectric substance having a particular color. On the other hand the movable electrode is, for instance, made of a metal-coated plastic thin film so as to be bent over the fixed electrode by an electrostatic force produced when a high-tension voltage is imposed between both the electrodes. The movable electrode bent over the fixed electrode covers its surface to change the seeming color of the fixed electrode, that is, the appearance of the display unit is changed. Therefore, the display board can be made to display a predetermined pattern by selecting the distribution of high voltage supplied to the electrostatic display units.

An example of such an electrostatic display unit is shown perspectively in FIG. 1 and cross-sectionally in FIG. 2, in which an electric circuit to supply voltage is also shown. In this example two electrode plates 1 and 2 constitute the fixed electrode, while an aluminum coated polyester or polycarbonate film 3 is the movable electrode. The upper portions 1C, 2C and lower portions 1A, 2A of the two electrode plates 1 and 2 are flat and set up opposite to each other in parallel, while the middle portions extrude inside forming semi-cylindrical prominences 1B and 2B. The film-like movable electrode 3 runs through a shim inserted in the narrowest clearance 4 made between the semi-cylindrical prominences 1B and 2B. The lower portion of the movable electrode 3 is fixed to an elecrode holder 6, which doubles as a terminal 14. The holder 6 of the movable electrode 3 is fixed between the lower portions 1A and 2A of the two electrode plates by means of a male and female spacers 5, 7 and bolts 9 and 8. Of course the spacers 5 and 7 are made of an insulating material. The inner surfaces of the electrode plates 1 and 2, at least the area above the narrowest space 4 between them, are coated with insulating paints having their respective particular colors different from each other. In addition to the above arrangement of the electrodes, an A.C. voltage is supplied, as is shown in FIG. 2, between the movable electrode 3 (via the terminal 14) and the electrode plates 1 and 2 (via the terminal 12 and 13) from a voltage source 10, with the polarity of the movable electrode 3 changed by a switch 11.

In the above constitution of the electrostatic display unit, the movable electrode 3 is attracted, in accordance with its polarity, by either the electrode plate 1 or 2, and covers the inner surface of either of the electrode plates 1 and 2. Thus the appearance of the display unit can be changed between the two colors applied to the inside surfaces of the fixed electrodes.

OBJECTS AND SUMMARY OF THE INVENTION

An object of the present invention is to provide, by using the above mentioned electrostatic display units, a display apparatus capable of displaying not only a fixed pattern but also a moving pattern like a series of flowing characters giving a message or news.

Another object of the present invention is to provide a display apparatus capable of reversing a displayed pattern between a positive and a negative image.

BRIEF DESCRIPTION OF THE DRAWINGS

The present invention is further described in detail in the following with reference to the attached drawings, in which.

DETAILED DESCRIPTION OF THE INVENTION

Figure 1:
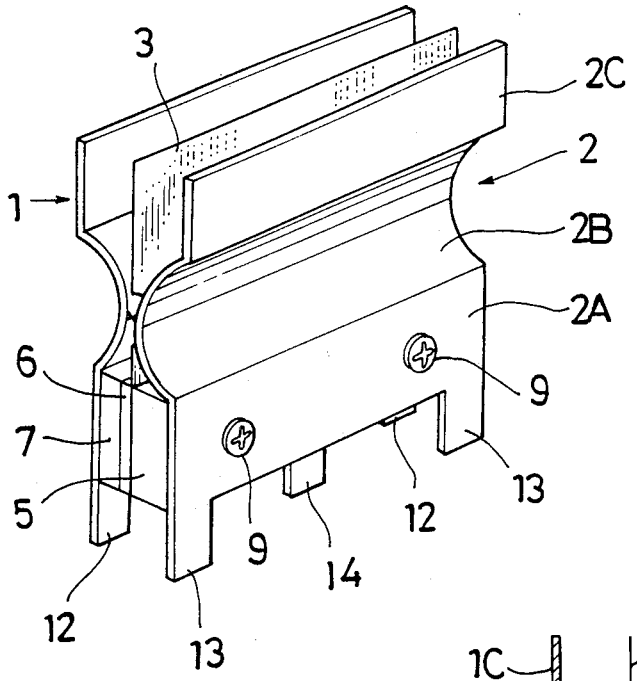
FIG. 1 shows a perspective view of an electrostatic display unit used in the present invention.
Figure 2:
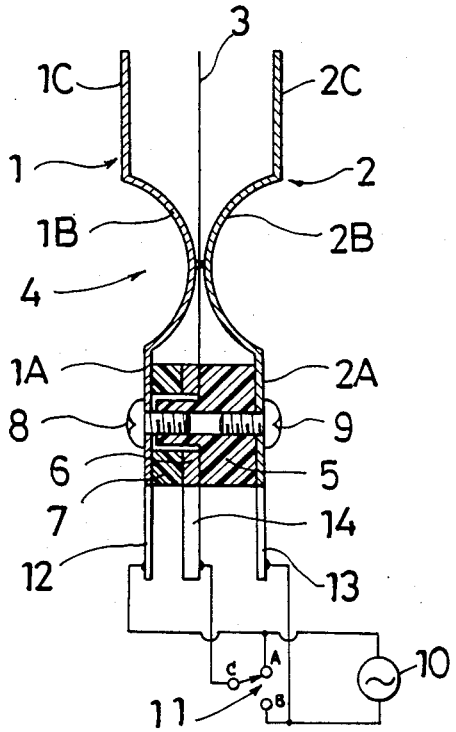
FIG. 2 shows a cross-sectional view of the above electrostatic display unit.
Figure 3:
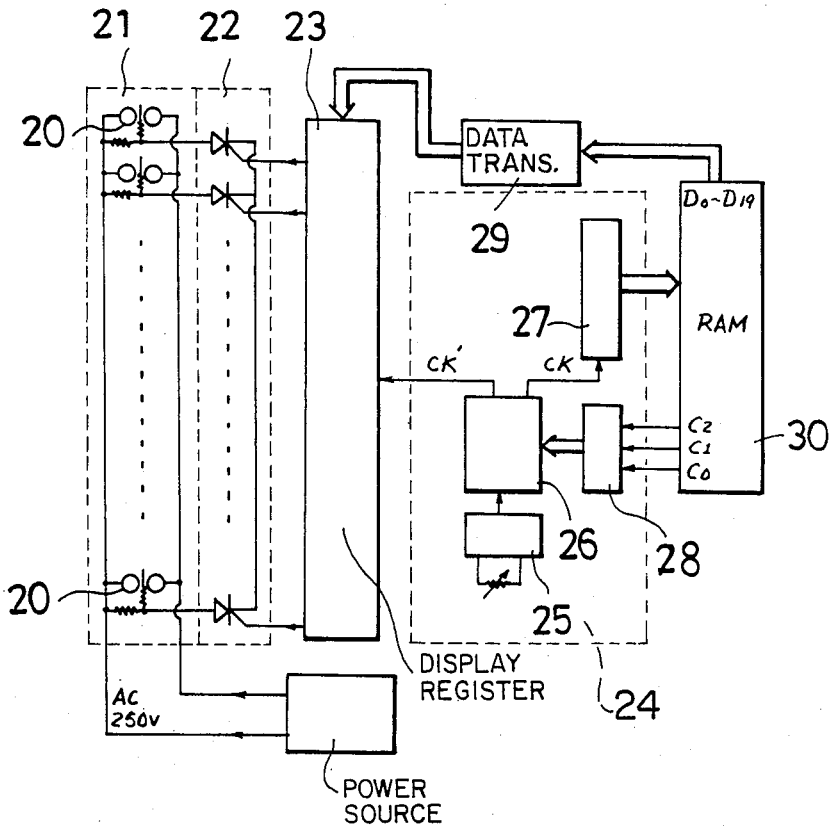
FIG. 3 shows a block diagram illustrating the constitution of an embodiment of the present invention.

In FIG. 3, which shows the entire constitution of an embodiment of the present invention, a display panel 21 is constituted by many electrostatic display units 20 (shown in FIGS. 1 and 2) arranged in the form of a matrix. The number of the display units is, for example, 20×200. A driving circuit 22 is constituted of thyristors, each of them corresponding to each of the display units 20 in the display panel 21. A display register 23 consists of shift registers to be shifted by the clock pulses CK, generated by a timing signal generator 26. Each bit of the display register 23 corresponds to each dot (each display unit) in the display panel 21. A control unit 24 comprises an oscillator (master clock) 25 for generating a fundamental frequency of clock pulses CL, the above timing signal generator 26 for generating the clock pulses CK′ and another series of clock pulses CK with the same frequency as that of CK′ by dividing the fundamental frequency outputted from the oscillator 25, an address counter 27 for counting the clock pulses CK, a decoder 28 for controlling the frequency division in accordance with control instruction signals $C_0$, $C_1$, $C_2$, and a data transmitter 29 for transmitting data signals from a memory 30 (to be mentioned later) to the display register 23 mentioned previously. The memory 30, which consists of a RAM, stores all display data and the control instructions corresponding to the display data. The control instructions are assigned three bits $C_0$, $C_1$ and $C_2$ for each column in the display data storing part in the memory 30. The assignment specifies the various modes as shown in Table 1.

TABLE 1

| $C_0$ | $C_1$ | $C_2$ | Mode |
|---|---|---|---|
| 0 | x | 0 | Normal display |
| 1 | x | 0 | Reversed display |
| x | 0 | 0 | Flowing display |
| x | 1 | 0 | High-speed shift |
| x | 0 | 1 | Stop |
| x | 1 | 1 | Return |

Figure 4:
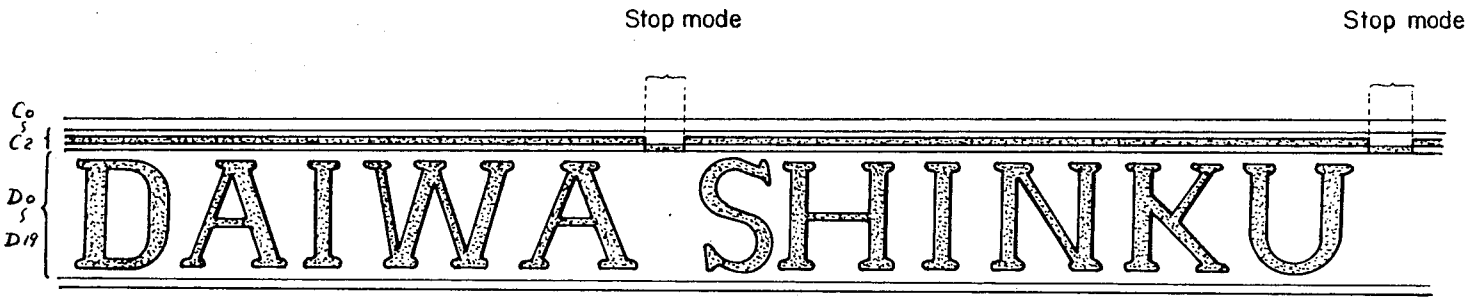
FIG. 4 shows an example of the formats stored in the memory 30 in FIG. 3.

FIG. 4 shows a format in the memory 30. The RAM is of a matrix type with 24 bits per column: 4 bits out of the 24 bits are assigned to store the control instructions and the remaining 20 bits are assigned to store the display data. In FIG. 4 the white-ground portions represent logic "0", while the black-dotted portions represent logic "1". For example, in case of the control instruction corresponding to the column in which a display data "DIAWA" is stored, $C_1=1$ and $C_2=0$. This combination specifies the High-speed shift mode. Also in case of the control instruction corresponding to the column in which the next display data "SHINKU" is stored, $C_1=1$ and $C_2=0$. To the contrary, in case of the control instructions corresponding to the columns in the blanks just after the above display data "DAIWA" and "SHINKU", $C_1=0$ and $C_2=1$. This logic combination specifies the Stop mode.

Figure 5:
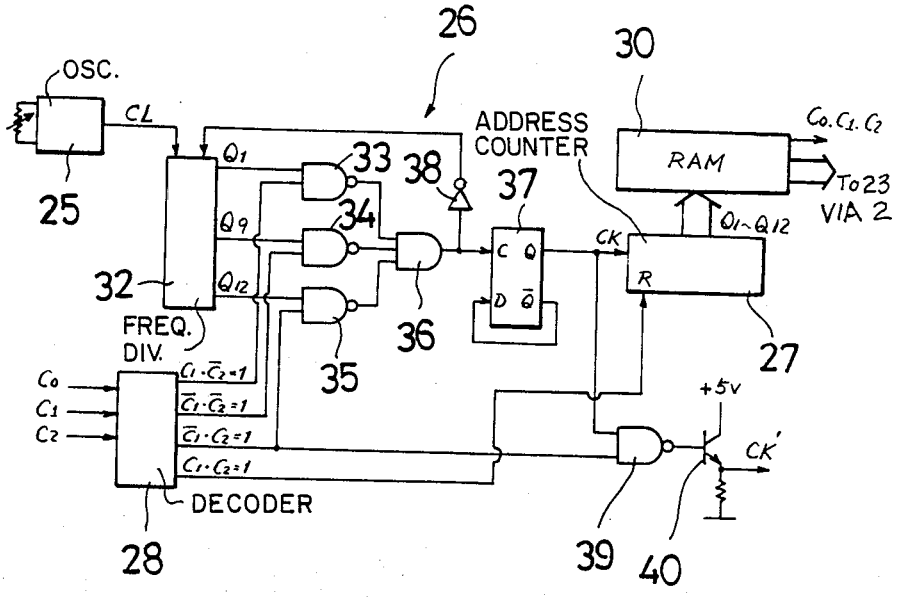
FIG. 5 shows the constitution of the timing circuit 26 in FIG. 3.

FIG. 5 shows a part of the control unit 24 and the relative, which part is for displaying a moving pattern by repeating the two modes of High-speed shift and Stop. A frequency divider 32 successively divides the frequency of the fundamental clock oscillation CL generated by the oscillator 25. Outputs $Q_1$, $Q_9$ and $Q_{12}$ are respectively the outputs from 1st stage (middle stage), 9th stage and 12th stage (last stage) of the frequency divider 32. Suppose that the frequency of the fundamental clock oscillation be $f_o$, the frequencies of $Q_1$, $Q_9$ and $Q_{12}$ are $f_o\times\frac{1}{2}$, $f_0\times(\frac{1}{2})^9$ and $f_o\times(\frac{1}{2})^{12}$, respectively. The outputs $Q_1$, $Q_9$ and $Q_{12}$ are provided for High-speed shift, for Flowing display and for Stop, respectively. NAND gates 33, 34 and 35 open with $C_1=1$, $C_2=0$, with $C_1=0$, $C_2=0$, and with $C_1=0$, $C_2=1$, respectively. The outputs from the NAND gates 33, 34 and 35 are inputted to an AND gate 36. The output from the AND gate 36 is sent to the frequency divider 32 through an inverter 38, and, in the same time, inputted to a flip-flop 37 which shapes the input into a pulse signal having a definite time width. The counter 27 is an address counter proceeding step by step according to the output Q from the flip-flop 37, and can output 4096 ($=2^{12}$) state-signals through twelve output terminals $Q_1, Q_2, \ldots, Q_{12}$. Addresses in the RAM 30 are selected by these state-signals. The data stored in the RAM 30 is outputted from data output terminals $D_0, D_1, \ldots, D_{19}$. The output from the flip-flop 37 is inputted also to a NAND gate 39 to make a transistor 40 output a shift pulse to the display register 23 (FIG. 3). In the Stop mode, however, the shift pulse is not outputted with the NAND gate 39 kept closed.

Figure 6:
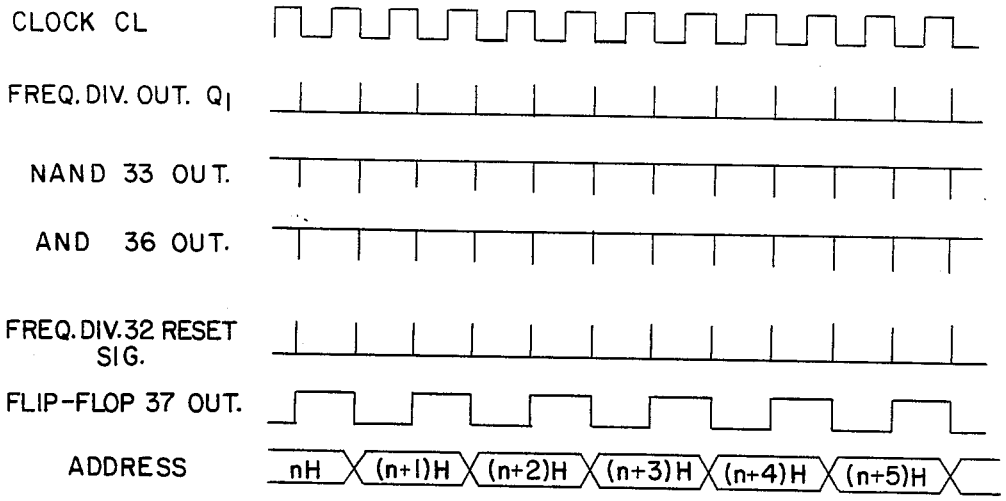
FIGS. 6 and 7 show time charts for explaining the function of the circuit shown in FIG. 5; and utilizing EXCLUSIVE OR circuits

Now suppose that the RAM 30 has stored, together with display data, the code ($C_1=1$, $C_2=0$) specifying the High-speed shift mode. FIG. 6 shows voltage waveforms at various parts in the mode of High-speed shift. As the NAND gates 34 and 35 always output "1", at the moment the output $Q_1$ of the frequency divider 32 turns to H (high level) to L (low level), the frequency divider 32 is reset by the circuit of the inverter 38, and the output from the AND gate 36 or the input to the flip-flop 37 become a minus sharp pulse. The flip-flop 37 outputs a square wave dividing the frequency of the minus sharp pulse. The square wave output makes the address in the RAM 30 proceed by one stop, and therefore the contents of the display register 23 proceed by one column synchronously with that step. However, the frequency of this proceeding pulse is 5 kHz, so the movable electrode of the electrostatic display unit 20 can not respond to the frequency, keeping the previous display unchanged. In this mode the frequency divider 32 is inevitably made to reset after outputting $Q_1$, so it can not proceed to the following stages to output $Q_9$, $Q_{12}$.

Figure 7:
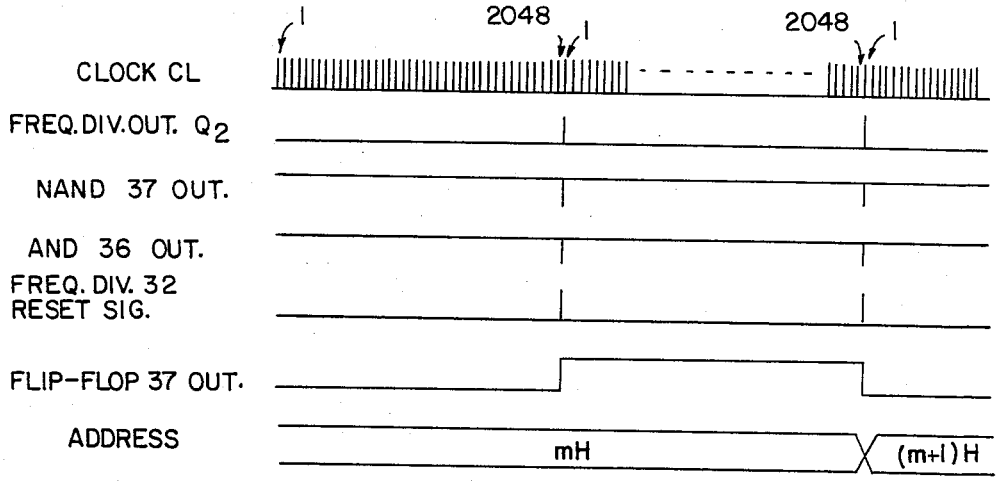

In case the address in the RAM 30 proceeds from the High-speed shift mode to the Stop mode ($C_1=0$, $C_2=1$), the NAND gate 35 turns ready to open, while the NAND gates 33 and 34 come to always output "1". The output $Q_{12}$ of the frequency divider 32 is outputted at 2048 ($=2^{11}$) times the period of $Q_1$. No sooner than the NAND gate 35 and the AND gate 36 open with $Q_2$ outputted, the frequency divider 32 is reset by the circuit of the inverter 38 similarly to the case of the previous High-speed shift mode. The AND gate 36, therefore, outputs a minus sharp pulse. FIG. 7 shows voltage waveforms at various parts in the present mode. FIG. 7 is drawn with the time scale compressed very much in comparison with FIG. 6. The number of addresses in which the present Stop instruction code is written is, for instance, four as shown in FIG. 4. The time needed for the counter 27 to proceed four addresses is, for instance, 1 second. During this time of stopping, the display register is not supplied with a shift pulse, and therefore the previous pattern "DAIWA" is kept displayed.

If the control instruction code returns to the high-speed shift mode, the contents of the display register 23 vary from "DAIWA" to "SHINKU" at a high speed. However, during the short time of this variation, the (electrostatic) display units 20 keep the display of "DAIWA" because, as mentioned above, they can not respond. After the address in the memory having come to the Stop mode following the "SHINKU", the movable electrodes of the display units 20 finally respond to the variation, and changes the display to "SHINKU" from "DAIWA".

In the following the Flowing display is described. This display is specified by $C_1=0$ and $C_2=0$. In this case the NAND gate 34 is kept ready to open, and the output $Q_9$ of the frequency divider 32 is outputted at 256 ($=2^8$) times the period of $Q_1$. The address in the memory proceeds at this period, to which the electrostatic display units can respond. Synchronously with the proceeding of the address, the columns in the display shift one by one.

Figure 8:
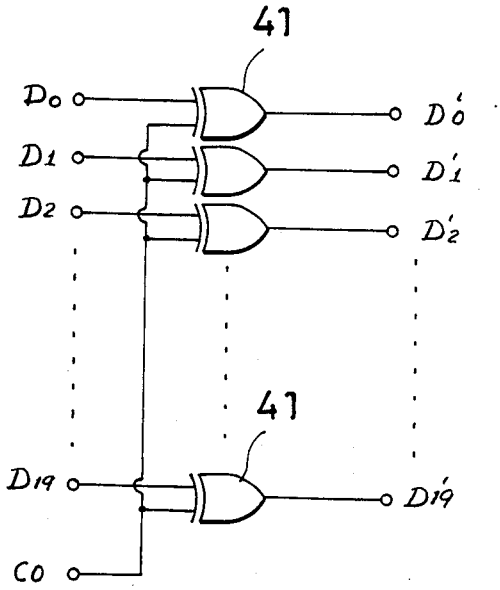
FIG. 8 shows a circuit constitution of the data transmitter 29 in FIG. 3.

FIG. 8 shows an example of the data transmission circuit 29 in FIG. 3 utilizing EXCLUSIVE OR circuits for data-logic reversing. The display data $D_0, D_1, \ldots, D_{19}$ from the memory is transmitted to the input terminals of the display register 23 through exclusive OR gates 41. In this case, one input line of each exclusive OR gate is commonly connected and supplied with a control instruction code $C_0$. As is shown in Table 1, $C_0=1$ is for Normal display (the display just indicated by the data stored in the memory) and $C_0=0$ is for Reversed display. The truth table for an exclusive OR gate is shown in Table 2 below.

TABLE 2

| $D_i$ | $C_0$ | $D'_i$ |
|---|---|---|
| 0 | 0 | 0 |
| 1 | 0 | 1 |
| 0 | 1 | 1 |
| 1 | 1 | 0 |

As is understood from this truth table, in case of $C_0=0$ $D_i(i=0, 1, 2, \ldots, 16)$ are outputted as they are, while, in case of $C_0=1$ $D_i$ are inverted to $D_i'$ and outputted. By this embodiment of the data transmission circuit, the circuit constitution is made simple, not being accompanied by time delay.

The return code of the control instruction is specified by $C_1=1$ and $C_2=1$. This code is usually specified just after the final data of a data series in the memory. In FIG. 5 the decoder 28, detecting $C_1=C_2=1$, gives a reset signal to the address counter 27 to return the address to 0. As a result the display 21 repeats the display of the same program.

What is claimed is:

1. An electrostatic display apparatus capable of displaying an animated pattern by making a static pattern vary successively, said apparatus comprising:

a display panel constituted of a plurality of electrostatic display units arranged in the form of a matrix consisting of a plurality of rows and a plurality of columns, each of said electrostatic display units having a pair of fixed electrodes kept oppositely to each other with their confronting surfaces coated with an electrically insulating layer, a movable electrode positioned between said pair of fixed electrodes, and lead wires for said fixed electrodes and said movable electrode, said fixed electrodes being voltage-supplied therebetween with said movable_electrode enabled to have its potential switched selectively to the potential of either of said fixed electrodes;

a display units driving circuit consisting of switching elements having one-to-one correspondence to said electrostatic display units;

a display register having bits corresponding to said electrostatic display units through said switching elements constituting said display units driving circuit, said bits being shifted by shift pulses in groups in correspondence to the electrostatic display units belonging to said columns in said matrix;

a memory for storing both display pattern data and display mode instruction codes, said display mode instruction codes including a high-speed display mode instruction code and a display stop mode instruction code, said high-speed display mode instruction code arranging said columns, said display stop mode instruction code following on said high-speed mode instruction code without arrangement of display pattern data;

a data transmitting means for transmitting said display pattern data from said memory to said display register in accordance with said shift pulses;

a frequency selection means for selecting the frequency of said clock pulses, in accordance with said high-speed display mode instruction code, to a first frequency which is too high to be responded to by said movable electrodes of said electrostatic display units or, in accordance with said display stop mode instruction code, to a second frequency which is markedly lower than said first frequency; and a means for preventing said shift pulses from being supplied to said register in accordance with said display stop instruction code while said second frequency is employed for said clock pulses.

2. An electrostatic display apparatus defined in claim 1, wherein said frequency selection means comprises a frequency divider for dividing the frequency of a master clock into a plurality of lower frequencies, and NAND gates for outputting frequencies purposely selected in accordance with said display mode instruction codes, and wherein, while the display mode instruction is being shifted by said high-speed display mode instruction code, the output from a first stage of said frequency divider has said first frequency and is supplied to said display register and said memory through a NAND gate appointed by said high-speed display mode instruction code, causing a high-speed data shift to be made on said display register without making said movable electrodes of said electrostatic display units respond to said high-speed data shift, and, while said display mode instruction is being specified by said display stop mode instruction code following on said high-speed display mode instruction code, the output from the last stage of said frequency divided has said second frequency, and said shift pulses are supplied to said memory but prevented from being supplied to said display register by the function of said NAND gates and said display stop mode instruction code, causing a stop of data shift made on said display register and thus giving said movable electrodes of said electro-static display units a period in which they move according to the display pattern data stored in said display register during said high-speed data shift, whereby the alternate repetition of said high-speed data shift and said stop of data shift causes an animated pattern display.

3. An electrostatic display apparatus capable of displaying a scrolling pattern and a static pattern, and also capable of reversing display patterns into a negative image, said apparatus comprising:

a display panel constituted of a plurality of electrostatic display units arranged in the form of a matrix consisting of a plurality of rows and a plurality of columns, each of said electrostatic display units having a pair of fixed electrodes kept oppositely to each other with their confronting surfaces coated with an electrically insulating layer, a movable electrode positioned between said pair of fixed electrodes, and lead wires for said fixed electrodes and said movable electrode, said fixed electrode being voltage-supplied therebetween with said movable electrodes enabled to have its potential switched selectively to the potential of either of said fixed electrodes;

a display units driving circuit consisting of switching elements having one-to-one correspondence to said electrostatic display units;

a display register having bits corresponding to said electrostatic display units through said switching elements constituting said display units driving circuit, said bits being shifted by shift pulses in groups in correspondence to the electrostatic display units belonging to said columns in said matrix;

a memory for storing display pattern data and display mode instruction codes, said display pattern data specifying display patterns to be displayed on said display panel and being outputted successively by clock pulses, and said display mode instruction codes including a scrolling display mode instruction code, a high-speed display mode instruction code, a display stop mode instruction code and a reverse display mode instruction code, said scrolling display mode instruction code being used in displaying said display pattern data in the form of a scrolling display preceding from left to right on said display panel, said high-speed display mode instruction code being used in displaying said display pattern data instantaneously one frame by one frame on said display panel, said display stop mode instruction code being used for inserting a pause in drawing out said scrolling display mode instruction code or said high-speed display instruction code, both included in said display mode instruction codes, and said reverse display mode instruction code being for inverting the logic of said display pattern data;

a data transmitting means for transmitting said display pattern data from said memory to said display register in accordance with said shift pulses;

a display mode switching means consisting of a first means for selecting the frequency of said clock pulses in accordance with the display mode specified by said display mode instruction codes excluding said reverse display mode instruction code and of a second means for reversing the logic of said display pattern data in accordance with said reverse display mode instruction code; and a means for preventing said shift pulses from being supplied to said register in accordance with said display stop mode instruction code.

4. An electrostatic display apparatus as defined in claim 3, wherein said first means for selecting the frequency of said clock pulses comprises a frequency divider for dividing the frequency of a master clock into a plurality of lower frequencies and NAND gates for outputting frequencies purposefully selected in accordance with said display mode instruction codes, and said second means for reversing the logic of said display pattern data is made of an EXCLUSIVE OR circuit, and wherein, while said scrolling display mode is being instructed by said display mode instruction codes, said first means selects the output from a middle stage of said frequency divider to keep the frequency of said clock pulses at a value to which said movable electrodes of said electrostatic display units can respond, and to supply said clock pulses to said display register and said memory, and when said reverse mode instruction code is arranged with said display scrolling mode instruction codes or said high-speed display mode instruction code, said EXCLUSIVE OR circuit reverses the logic of the display pattern data from said memory to make said display panel display reverse patterns.

* * * * *